US006081286A

United States Patent [19]

Fotland

[11] Patent Number: 6,081,286

[45] Date of Patent: Jun. 27, 2000

[54] METHOD AND APPARATUS FOR HIGH SPEED CHARGE IMAGE GENERATION

[76] Inventor: Richard Allen Fotland, 220 Chamberlain St., Holliston, Mass. 01746

[21] Appl. No.: 09/071,857

[22] Filed: May 2, 1998

[51] Int. Cl.[7] ..... B41J 2/415; G01D 15/06

[52] U.S. Cl. ..... 347/128; 347/141

[58] Field of Search ..... 347/120, 127, 347/128, 141

[56] References Cited

U.S. PATENT DOCUMENTS

| | | | |
|---|---|---|---|
| 4,155,093 | 5/1979 | Fotland et al. . | |
| 4,160,257 | 7/1979 | Carrish . | |
| 4,658,275 | 4/1987 | Fujii et al. | 347/128 |
| 4,999,653 | 3/1991 | McCallum . | |
| 5,006,869 | 4/1991 | Buchan . | |
| 5,357,274 | 10/1994 | Kitamura | 347/128 X |

OTHER PUBLICATIONS

Kubelik, Igor; "Limiting Factors of High Resolution and Gray Scale Ionographic Printing"; SPIE, vol. 1252 (1990) pp. 45–76.

Fotland, Richard; "Ion Printing: past, present, and future"; SPIE, vol. 1252 (1990) pp. 18–24.

*Primary Examiner*—Fred L. Braun

[57] ABSTRACT

An apparatus for high-speed charge latent image generation which employs two or more charge generating matrix sets. These matrix sets are electrically connected so that image charges are simultaneously generated from each set. Charge from the matrix sets is deposited upon a dielectric image receptor surface adapted to move longitudinally with respect to the charge image generation apparatus. The charge image is in the form of dots that are formed using two or more sets of independently controlled matrix arrays that are spaced from each other in a longitudinal direction. The matrix sets are laid out so that the dots from any one set are interleaved among the other sets, resulting in the power loading to the charge image generating apparatus being distributed over a larger area. The method performed by such apparatus permits greater spacing of the matrix elements and results in minimizing artifacts in the latent electrostatic charge image.

9 Claims, 2 Drawing Sheets

METHOD AND APPARATUS FOR HIGH SPEED CHARGE IMAGE GENERATION

BACKGROUND OF THE INVENTION

The present invention relates to the generation of charged particles, and more particularly to the high-speed generation of charged particle images for electrographic imaging.

Charged particles for use in electrographic imaging can be generated in a wide variety of ways. Common techniques include the use of air gap breakdown, corona discharges and spark discharges. Other techniques employ triboelectricity, radiation, and microwave breakdown. When utilized for the formation of latent electrostatic images, all of the above techniques suffer certain limitations in charged particle output currents and charge image integrity.

A further approach, which offers significant advantages in this regard, is described in Fotland, U.S. Pat. No. 4,155,093 (May 19, 1979) and the improvement disclosed in Carrish, U.S. Pat. No. 4,160,257 (Jul. 3, 1979). These patents disclose a method and apparatus for generating charged particles in air involving what the inventors' term "silent electric discharge". The prior art general view of FIG. 1 shows an image generating printhead, 8 capable of forming an electrostatic latent image on dielectric receptor 25. The printhead 8 is supplied with a high voltage alternating potential 10 applied between two electrodes; i.e., generator electrode 12 and control electrode 14. Electrode 14 contains a plurality of circular or slotted apertures opposing generator electrode 12. A solid dielectric member 16 separates these electrodes. Driver electrode 12 is shown encapsulated by dielectric 18. As disclosed in U.S. Pat. No. 4,155,093, the alternating potential causes the formation of a pool or plasma of positive and negative charged particles in an air region adjacent the dielectric, which charged particles may be extracted to form a latent electrostatic image. The alternating potential 10 creates a fringing field between the two electrodes and, when the electrical stress exceeds the dielectric strength of air, a discharge occurs quenching the field. Such silent electric discharges cause a faint blue glow.

U.S. Pat. No. 4,160,257 teaches the use of an isolation electrode, 20, separated from the control electrode 14 by a dielectric spacer layer 22. Electrode 20 serves to screen the extraction electric fields in the region bounded by electrodes 14 and 20 from the external fields of the latent image. In addition, the aperture 24 in electrode 20 provides an electrostatic lensing action. Charged particles are permitted to pass through the isolation aperture 24 to the surface of the image receptor 25. The image receptor dielectric layer 26 is contiguous with conducting substrate 28.

The use of negative charges (electrons and negative ions) is preferred since higher negative output currents are obtained than when employing positive charges. Biasing power supply 34 is used to provide a high-voltage accelerating field between dielectric receptor substrate 28 and isolation electrode 20. Negative charges are extracted from the discharge when the print selector switch 36 is in position Y. In this case, a charge extraction field, provided by power supply 30, is present between electrodes 14 and 20. With the switch in position X, a retarding field is applied by supply 32 and no charge may escape aperture 24.

The requirement that both a high frequency voltage and an extraction voltage be simultaneously present to generate a charge output provides the means for coincident selection so that the charge latent image generator may be multiplexed. As seen in the prior art view of FIG. 2, the charged particle generators of the above-discussed patents may be embodied in a multiplexed print head 40, wherein an array of control electrodes 50-1 through 50-6 contain holes or slots 45 at crossover regions opposite generator electrodes 60-1 through 60-4. Dielectric layer 41 isolates generator and driver electrodes. Driver electrodes are sequentially excited by a high frequency high voltage burst of cycles, and any location in the matrix may be printed by applying a data, or control, pulse to the appropriate control electrode at the time that the corresponding generator line is excited.

This basic scheme of multiplexing has been extensively employed in print heads having resolutions ranging from about 7.8 dots per millimeter to 23.6 dots per millimeter with the number of generator lines ranging from 12 to 21. Since the human eye is quite sensitive to periodic optical density variations in this spatial frequency region near one cycle per millimeter, the periodic control line repeat of about one-millimeter can lead to an observable fixed streak pattern in the direction of paper travel below printhead 8. There are three potential sources for this problem. An error in the print head mounting will cause a periodic variation in pixel spacing since the print head array is spread over a two dimensional pattern. Secondly, a variation in print head to dielectric receptor spacing naturally occurs when printing from a planar print head onto a cylindrical dielectric receptor surface. The reduced field at the extreme ends of the print head then results in lower output current in these regions. Finally, as the image is laid down there has to be a last down pixel whose size is affected by the fringing field of neighboring pixels.

These defects are minimized by using care in the design of the print head mounting mechanism, printing onto a large radius dielectric receptor or designing overhang compensation into the print head, and by arranging the print head geometry such that the pixels are interleaved. This last improvement decreases the pitch of the fixed pattern noise from about one-millimeter to one-half of the print head aperture spacing.

A number of U.S. patents have issued which disclose improved methods of manufacture or geometry and two of these disclose variations of multiplexing geometry which provide interleaving in the manner in which the dots are placed on the surface of the dielectric receptor. McCallum, U.S. Pat. No. 4,999,653 (Mar. 12, 1991) discloses a control line geometry that is staggered to provide for interleaving of the printed dots. Buchan, U.S. Pat. No. 5,006,869 (Apr. 9, 1991) solves this problem by etching the generator lines in the form of a chevron or by having each control line contain staggered apertures.

Charge latent image formation operating speeds are limited both by the number of available charging cycles each pixel requires and by the current output of the print head. The speed limitation imposed may be calculated from the following formula:

$$S=f/(cnr) \text{ meters/second}$$

Wherein

S=maximum printing speed f=operating frequency of generator oscillator c=number of cycles required to print a pixel n=number of generator electrodes in the print head r=resolution of print head Taking, for example, an oscillator frequency of 5 megahertz, a cycle requirement of 6 cycles to obtain good image density, 22 generator electrodes, and a resolution of 23,600 apertures per meter, the maximum print speed is calculated to be 1.6 meters per second. The maximum spacing between adjacent control electrodes is approximately equal to the number of generator lines divided by the distance between adjacent resolution elements. For the above example, this spacing is 0.93 millimeters. The true distance between adjacent control electrodes is actually somewhat smaller since the control electrodes are slightly angled with respect to the direction of printhead motion. With sufficient spacing between generator lines, the actual spacing is relatively close to that given above.

The high frequency discharge in air results in the formation of minute quantities of nitric acid, active oxygen, and other highly corrosive compounds. In addition, the high frequency operation results in the generation of appreciable quantities of heat in the very small regions at the discharge site in and around the generator electrode apertures. For these reasons, it is desirable to form the generator electrode from corrosion resistant metal foils having a thickness of at least about 12 microns. Stainless steel foil is widely employed in this application. Reduced corrosion rates are realized with the use of very corrosion resistant materials such as molybdenum, tungsten, or tantalum. These materials are photo-etched by coating or laminating a photosensitive resist to the foil. The resist is exposed, developed, and the foil then chemically etched. It is difficult to etch complex structures in these corrosion resistant films with precision at very close spacing, particularly since each control electrode must contain a plurality of etched holes. Furthermore, the close spacing places a very high thermal load in a very small area. A conflict exits, therefore, between operation at high speeds and available resolution. For these reasons, present commercially available print heads are limited to a maximum resolution of 12 dots per millimeter using 12 generator electrodes and 24 dots per millimeter at 19 generator electrodes.

In order to generate the high output currents required of high-speed operation, it is desirable to etch the apertures to diameters of about 0.15 mm. The edges of the control electrodes must be sealed with a dielectric in order to eliminate air breakdown at these edges. This constraint also leads to a requirement for control line spacing of about 0.9 mm or greater.

Operation at frequencies over five megahertz results in high power density loading in the printhead as well as difficulties involving excessive RF emission. Although frequencies as high as ten megahertz have been employed in the laboratory, five-megahertz is the highest frequency that has been employed in commercial printers.

Accordingly, it is a principal object of the invention to provide an improved easily manufactured charge image generator capable of operating at high speeds. A further objective of the invention is to simplify fabrication of the charge image generator apparatus. A still further objective of the invention is to minimize artifacts in the charge image caused by periodic variations in the matrix array. Related objectives are to reduce the power density loading of the print head and also to provide for interleaved dot operation in order to avoid fixed pattern noise.

SUMMARY OF THE INVENTION

In fulfilling the above and additional objectives, the invention provides an improved charge image generator comprising a least two sets of generator electrodes substantially in contact with one side of a first solid dielectric member and at least two sets of control electrodes substantially in contact with the other side of the dielectric member. The improvement of this invention relates to charge image generators as shown and described, for example, in Fotland et al U.S. Pat. No. 4,155,093 and Carrish U.S. Pat. No. 4,160,257 which description is incorporated herein by reference. These references describe the use of a high frequency alternating potential applied between a generator electrode and control electrodes to cause an electrical air-gap breakdown in fringing field regions located adjacent the control electrodes. A third "screen" electrode is separated from the control electrode by a second layer of dielectric. Electric charges produced by the air gap breakdown can be extracted subject to the influence of an electrical field applied between the control and screen electrodes.

The use of multiple sets of generator electrodes, each set associated with its own set of control electrodes, allows the active charge generation area to be enlarged with a subsequent reduction of printhead power density loading. This improvement also enables increased physical separation between adjacent control electrodes.

BRIEF DISCRIPTION OF THE DRAWINGS

FIG. 1 is a sectional schematic view of a prior art charge image generator of the type as shown in U.S. Pat. No. 4,160,257.

FIG. 2 is a sectional schematic view of a prior art charge image generator multiplexing arrangement of the type as shown in U.S. Pat. No. 4,155,093.

DETAILED DISCRIPTION

Figure 1:
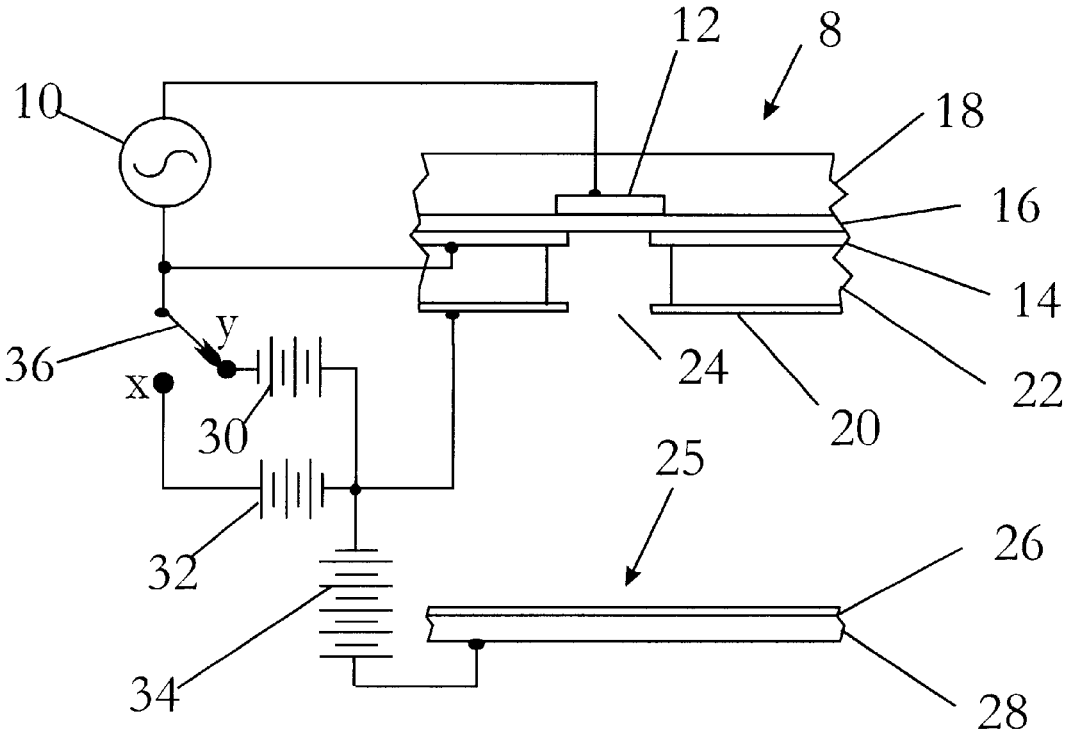
FIG. 1 (PRIOR ART)
Figure 2:
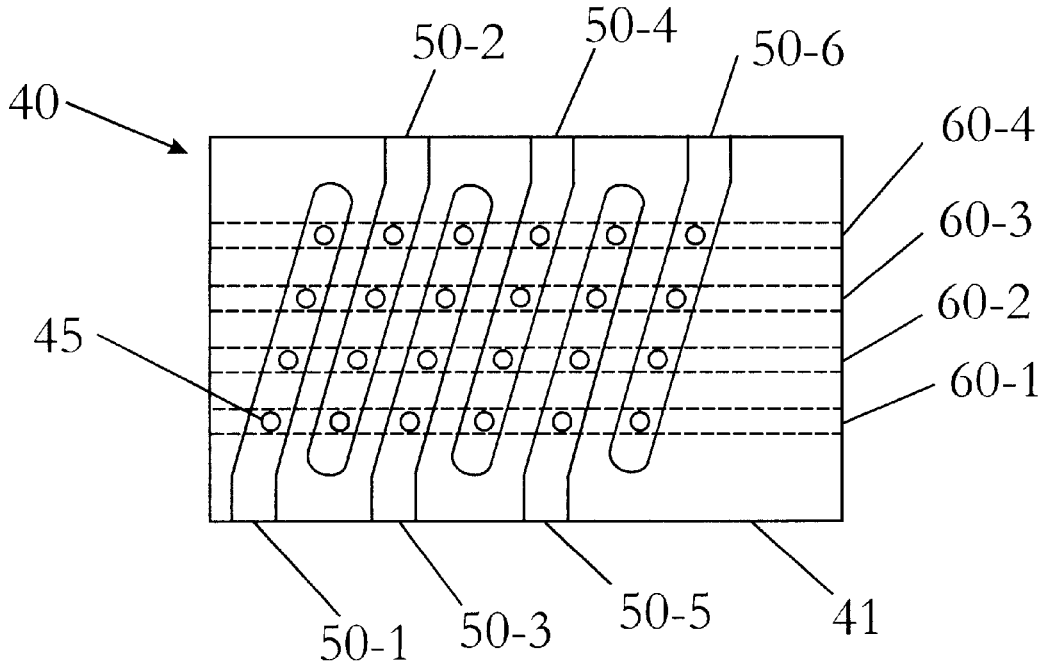
FIG. 2 (PRIOR ART)
Figure 3:
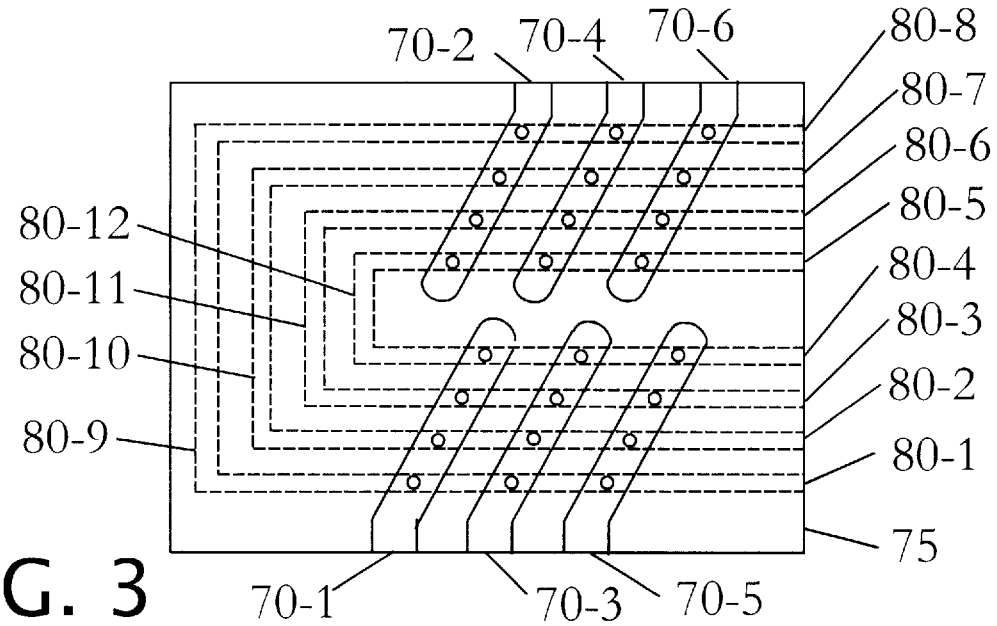
FIG. 3 is a sectional schematic view showing a charge image generator having two sets of generator and control electrodes in accordance with a first embodiment of the invention.

Reference should now be had to FIG. 3 which illustrates a charge image generator according to a first embodiment of the invention. Dielectric layer 75 separates generator lines 80-1 through 80-8 from control electrodes 70-1 through 70-6. The two sets of generator lines are shown internally connected by etched conducting traces 80-9 through 80-12 so that generator line 80-1 is activated simultaneously with generator line 80-8 and so forth. Motion of the printhead relative to the dielectric receptor is longitudinal (from top to bottom as viewed in FIG. 3) and the generator electrodes extend in a transverse direction to this motion. It is apparent that, for generating charge dots at the same pitch, the control electrode spacing employing two sets of generator and control electrodes is double that obtained using a single set of electrodes as illustrated in FIG. 2. By extending the active area of the printhead in a longitudinal direction, the distance between control electrodes is increased leading to a reduction in fabrication difficulty as well as a reduction in power input density to the printhead. The arrangement of FIG. 3 also provides for the interleaving of charged dots on the surface of the dielectric receptor. For example, if the dielectric receptor is moving in an upward direction with respect to the printhead sketch of FIG. 3, then the first set of dots will be placed using control electrodes 70-1, 70-3, and 70-5. The second set of dots will next be formed using control electrodes 70-2, 70-4, and 70-6. Thus, the two sets of electrodes provide for interleaving of any dots placed upon the dielectric surface.

For clarity, only four generator electrodes and six control electrodes are shown in this figure although it should be understood that typical printheads will have between about six and about twenty-one generator electrodes and several hundred control electrodes to provide a latent image over a transverse width of about eight to about eighteen inches.

The control electrodes in each set are shown overlapping in such a manner that the end print-aperture of each control electrode is not opposing an end print-aperture in a member of the other control electrode set. This feature improves print quality since it has been found that the dots printed with the end apertures slightly differ from those printed by apertures not on the ends. Thus, by staggering the sets with respect to each other, this effect is minimized.

While the generator electrodes are shown in FIG. 3 as being internally connected, members of each set may, alternately, be connected externally. Furthermore, separate excitation of all generator lines may be employed. This may be required, for example, in cases where the RF oscillator power is only adequate to drive one set of generator lines.

Figure 4:
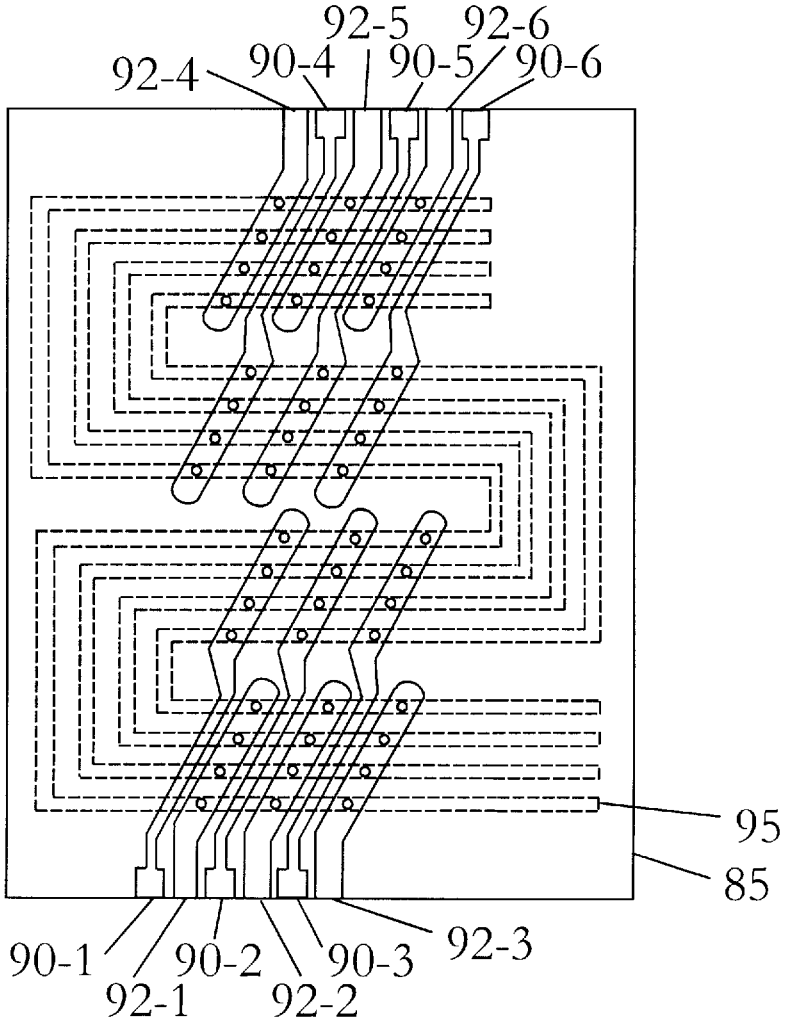
FIG. 4 is a sectional schematic view showing a charge image generator having four sets of generator and control electrodes according to an alternate embodiment of the invention.

FIG. 4 shows the use of four sets of generator electrodes together with four sets of control electrodes. For a given printing resolution (dots per mm) the transverse density of control electrodes is reduced by a factor of four compared to designs following the prior art. Here, the dielectric 85 separates the four sets of internally connected generator electrodes 95 and the four sets of independent control electrodes 90-1 through 90-6 and 92-1 through 92-6. The two sets of internal control electrodes 92-1 through 92-6 have narrow connection traces that extend between the outer two sets of control electrodes. These connection traces, as well as the connection pads of control electrodes 92-1 through 92-6, terminate in printhead connector pads shown at the edge of dielectric 85. Alternately, connection to the two center arrays of control electrodes may be made employing through-hole connections thus eliminating the narrow traces extending between the outer two arrays of control electrodes.

Again, print quality is optimized if each set of control electrodes is interleaved so those apertures at the end of any control electrode fall between non-end apertures of any other control electrode.

The following example outlines the dimensions of a printhead designed to print at a resolution of 24 dots per mm (600 dots/inch) over a 300-mm width. Two sets of eight generator electrodes would be employed. Transverse control electrode spacing is then 1.5 mm and there are 450 control electrode contacts on each side of the printhead. This printhead thus is capable of individually controlling 7200 dots. The control electrode spacing is slightly less than 1500 microns. A typical control electrode aperture diameter is 100 microns. If 100 microns is provided for the electrode land between the aperture and the edge of the electrode, then these electrode edges are spaced about 1200 microns apart.

The spacing between successive generator electrodes must be equal to an integral multiple of the longitudinal dot spacing. This requirement is imposed by the time division multiplexing of the printhead and arises since any printed dot must lie upon the resolution matrix. The spacing must be corrected by a small amount to compensate for the longitudinal relative motion of the dielectric receptor and printhead. A convenient spacing at a resolution of 24 dots per mm is 8 dot intervals or ⅓ mm. If the separation of the two sets of generator electrodes is selected to be equal to 16 dot intervals, then the longitudinal dimension of the active area of the printhead is about 5.33 mm. Each generator would be 167 microns in width if the ⅓-mm spacing were equally partitioned between the electrode and the dielectric separation between electrodes. This width provides more than adequate overlap for the 100-micron aperture in the control electrode.

The operating speed limitation of this printhead of this example is be calculated using the previous formula and found to be 4.34 meters per second or about 800 feet per minute.

It is to be understood that variations, modifications, and rearrangements may be made which still come within the scope of the invention. One such arrangement, for example, might involve a plurality of control line sets used in a manner such that only a few sets are employed when printing at lower resolution levels and, for highest resolution, all sets are activated.

What is claimed is:

1. Apparatus for generating electrostatic charge images on a receptor surface arranged to move longitudinally thereof, said appratus comprising:

a solid dielectric member having first and second sides;

at least two sets of generator electrodes substantially in contact with the first side of the solid dielectric member and extending transversely with respect to the movement of the receptor surface, each set of said generator electrodes being displaced longitudinally to all other sets, said generator sets being electrically connected so as to be excited in parallel;

at least two sets of control electrodes substantially in contact with the second side of the solid dielectric member and extending angularly with respect to the generator electrodes, the control electrodes in each set having apertures, including end print apertures on each control electrode, aligning with generator electrodes, the control electrodes in each set being so arranged that they align longitudinally with the electrodes in all other sets of control electrodes, and the end print aperture of each control electrode is offset laterally from the end print aperture of the next adjacent longitudinally spaced control electrode, the remaining apertures of each control electrode being interleaved in a similar manner to the end print aperture with the remaining apertures of its next adjacent longitudinally spaced control electrode;

each set of control electrodes being electrically isolated from control electrodes in any other set.

2. Apparatus as defined in claim 1 wherein the generator electrode sets are electrically connected internally.

3. Apparatus as defined in claim 1 wherein the generator electrode sets are externally electrically connected.

4. Apparatus as defined in claim 1 wherein the generator electrodes are connected individually to high frequency oscillators.

5. A method for generating electrostatic charge images on a receptor surface comprising the steps of:

providing an image generating printhead capable of forming an electrostatic latent image, said printhead being constructed with a plurality of generator electrodes and a plurality of control electrodes, providing at least two sets of control electrodes having image forming apertures thereon, including end print apertures on each control electrode, arranging the control electrodes in each set so that they align longitudinally with the electrodes in all other sets of control electrodes, with the end print aperture of each control electrode being laterally offset from the end print aperture of the next adjacent longitudinally spaced control electrode, and with the remaining apertures of each control electrode being interleaved in a similar manner to the end print aperture with the remaining apertures of its next adjacent longitudinally spaced control electrode, providing at least two sets of generator electrodes, each set of generator electrodes being associated with a set of control electrodes, exciting said generator electrode sets in parallel while moving said receptor surface longitudinally with respect to said printhead, and generating charge dots on said receptor surface whereby lines of dots formed on said image receptor by one set of such apertures are interleaved with the dots formed by said other set of image forming apertures.

6. The method of claim 5 wherein the sets of charge image forming control electrodes that are provided are of an odd number.

7. The method of claim 5 wherein the sets of charge image forming control electrodes that are provided are of an even number.

8. The method of claim 5 wherein the sets of generator electrodes are internally connected.

9. The method of claim 5 wherein the sets of generator electrodes are externally connected.

* * * * *